United States Patent [19]

Koumura

[11] Patent Number: 4,580,541

[45] Date of Patent: Apr. 8, 1986

[54] METHOD OF CONTROLLING OPERATING AMOUNTS OF OPERATION CONTROL MEANS FOR AN INTERNAL COMBUSTION ENGINE

[75] Inventor: Takashi Koumura, Iruma, Japan

[73] Assignee: Honda Giken Kogyo Kabushiki Kaisha, Tokyo, Japan

[21] Appl. No.: 663,425

[22] Filed: Oct. 22, 1984

[30] Foreign Application Priority Data

Oct. 20, 1983 [JP] Japan ..... 58-196889
Oct. 20, 1983 [JP] Japan ..... 58-196890

[51] Int. Cl.[4] ..... F02M 51/00
[52] U.S. Cl. ..... 123/478; 123/587
[58] Field of Search ..... 123/478, 480, 587

[56] References Cited

U.S. PATENT DOCUMENTS 4,300,506 11/1981 Knapp et al. ..... 123/478
4,413,601 11/1983 Matsuoka et al. ..... 123/480
4,465,051 8/1984 Hasegawa ..... 123/478
4,497,300 2/1985 Maruyama et al. ..... 123/478

*Primary Examiner*—William A. Cuchlinski, Jr.
*Attorney, Agent, or Firm*—Lyon & Lyon

[57] ABSTRACT

A method of controlling an operating amount of an operation control means for controlling the operation of an internal combustion engine having an intake passage and an intake air quantity control means for adjusting the opening area of the intake passage to thereby regulate the quantity of intake air of the engine. The operating amount of the operation control means, such as a fuel injection control means, is controlled to required values dependent on operating conditions of the engine, in synchronism with generation of pulses of a predetermined control signal. When the engine is operating in a predetermined low load condition, a desired operating amount of the control means is determined on the basis of the detected value of the intake passage opening area. A correction value is determined on the basis of a difference between the detected value of the intake passage opening area and the actual value of same, to correct the desired operating amount, and the operating amount is controlled to the corrected desired operating amount. Preferably, the correction value is determined in synchronism with generation of pulses of the predetermined control signal, from the desired operating amount based on the detected value of the intake passage opening area, and a second desired operating amount determined on the basis of the detected values of intake passage pressure downstream of the intake air quantity control means and the rotational speed of the engine. The correction value may alternatively be determined on the basis of a given voltage supplied from a variable voltage-creating means which is humanly adjustable.

11 Claims, 9 Drawing Figures

METHOD OF CONTROLLING OPERATING AMOUNTS OF OPERATION CONTROL MEANS FOR AN INTERNAL COMBUSTION ENGINE

BACKGROUND OF THE INVENTION

This invention relates to a method of controlling the operating amount of an operation control means for an internal combustion engine, and more particularly to a method of this kind which is adapted to constantly properly correct differences between the actual values of opening areas of the throttle valve and control valves for controlling the quantity of supplementary air being supplied to the engine, and the detected values of the opening areas of the same valves, to thereby control with accuracy the operating amount of the operation control means to a required value while the engine is operating in a low load condition such as at idle.

A method has been proposed, e.g. by Japanese Provisional Patent Publications (Kokai) Nos. 58-88436 and 53-8434, which determines a basic operating amount of operation control means for controlling the operation of the engine, such as a basic fuel injection amount to be supplied to the engine by a fuel supply quantity control system, a basic value of spark ignition timing to be controlled by an ignition timing control system, and a basic recirculation amount of exhaust gases to be controlled by an exhaust gas recirculation control system, in dependence on absolute pressure in the intake pipe of the engine and engine rotational speed, and corrects the basic operating amount thus determined in response to the temperature of intake air, the temperature of engine cooling water, etc., to thereby set a desired operating amount for the operation control means with accuracy. With this proposed method of determining operating amounts of the operation control means in dependence on the intake pipe absolute pressure and the engine speed (generally called "the speed density method", and hereinafter merely referred to as "the SD method"), while the engine is operating in a low load condition, i.e. in an idling condition, there occurs a reduction in a rate of change in the intake pipe absolute pressure relative to the lapse of time with respect to a rate of change in the engine speed relative to the lapse of time and also pulsation occurs in the intake pipe absolute pressure, making it difficult to set with accuracy an operating amount such as a fuel supply quantity in accordance with operating conditions of the engine, resulting in hunting of the engine rotation.

To solve the above problem, a method has been proposed, e.g. by Japanese Patent Publication No. 52-6414, which is based upon the recognition that the ratio (PBA/PA') of intake pipe pressure PBA downstream of the throttle valve to intake pipe pressure PA' upstream of the same valve is below a critical pressure ratio (=0.528) at which the intake air forms a sonic flow, while the engine is operating in a low load condition such as at idle, and that the quantity of intake air passing the throttle valve is not dependent upon pressure PBA in the intake pipe downstream of the throttle valve or pressure of the exhaust gases but on the valve opening of the throttle valve. Therefore, this proposed method detects the valve opening of the throttle valve alone to thereby detect the quantity of intake air while the engine is operating in the low load condition, and then sets an operating amount such as a fuel injection quantity on the basis of the detected value of the intake air quantity.

If the manner of detecting the intake air quantity, described above, is applied to control of the fuel injection quantity for instance, it is necessary to determine a fuel injection quantity as a function of the engine speed as well as the intake air quantity determined as above. This is because, although the quantity of intake air passing the throttle valve per unit time is constant so far as the opening area of the throttle valve remains the same, the quantity of air sucked into the engine per suction stroke varies in dependence on the engine speed. Thus, a basic fuel injection period Ti of the fuel injection valves is determined by using the following equation, for supply of fuel to the engine:

$$Ti=(K\theta+KAIC+\ldots)\times Me$$

where $K\theta$, KAIC, etc. represent opening area coefficients which are determined by respective opening areas of the throttle valve, control valves which control the quantity of supplementary air being supplied to the engine, etc. Me represents the interval of time between adjacent pulses of a pulse signal having its pulses generated at predetermined crank angles of the engine, e.g. at the top-dead-center (TDC) positions of pistons of the engine, a value of which is proportional to the reciprocal of the engine speed.

With this method of determining the basic fuel injection period by the use of the equation given above (hereinafter merely called "the KMe method"), it can occur that the opening area coefficients $K\theta$, KAIC, etc. are not set to accurate values corresponding to the actual opening areas, due to differences in value between the actual opening areas of the throttle valve and the control valves and the detected opening areas of the same valves, as caused by variations in the performance or locating error at installation of the throttle valve opening sensor, or by adhesion of carbon etc. contained in the blow-by gas and the atmosphere to the throttle valves and the control valves. Further, in the event of clogging of the air filter attached to an end of the intake pipe opening into the atmosphere, even if the actual opening areas of the throttle valve and the control valves are detected with accuracy, the actual intake air quantity can be smaller than a value of intake air quantity detected from the actual opening areas, resulting in the air/fuel mixture being enriched. To avoid these disadvantages, a possible measure may be to add or subtract a certain correction value which is a fixed value to or from the basic fuel injection period Ti value determined by the aforegiven equation at delivery of engines from the factory or at maintenance of same. According to this measure, however, since the basic fuel injection period Ti is calculated by multiplying the sum of the values of the opening area coefficients $K\theta$, KAIC, etc. by the value of time interval Me between adjacent TDC pulses, proportional to the reciprocal of the engine speed, accurate correction of the basic fuel injection period Ti cannot be achieved by the use of the certain correction value at engine rotational speeds other than a reference engine speed with reference to which the certain correction value has been set.

SUMMARY OF THE INVENTION

It is the object of the invention to provide a method of controlling the operating amount of an operation control means for controlling an internal combustion engine, which is adapted to properly correct differences in value between the actual opening areas of the throttle valve and the control valves and the detected opening areas of the same valves, and thereby control with accuracy the operating amount of the operation control means to a value appropriate to a low load condition of the engine such as at idle, to thereby improve the driveability, emission characteristics and fuel consumption of the engine.

The present invention provides a method of controlling an operating amount of an operation control means for controlling the operation of an internal combustion engine having an intake passage, and an intake air quantity control means for regulating the quantity of intake air being supplied to the engine through the intake passage by adjusting the opening area of the intake passage. The operating amount is controlled to required values dependent on operating conditions of the engine, in synchronism with generation of pulses of a predetermined control signal. The method is characterized by comprising the following steps: (1) determining whether or not the engine is operating in a predetermined low load condition; (2) detecting a value of the opening area of the intake passage, when the engine is determined to be operating in the predetermined low load condition; (3) determining a desired value of the operating amount of the operation control means on the basis of the detected value of the opening area of the intake passage; (4) determining a correction value on the basis of a difference between the detected value of the opening area of the intake passage and an actual value of same; (5) correcting the desired value of the operating amount determined at the step (3) by the correction value; and (6) controlling the operating amount of the operation control means to the desired operating amount thus corrected.

According to a preferred embodiment of the invention, a method is provided for controlling the quantity of fuel being supplied to an internal combustion engine having an intake passage, a throttle valve arranged in the intake passage, at least one auxiliary air passage opening into the intake passage at a location downstream of the throttle valve and communicating with the atmosphere, and at least one control valve arranged in the auxiliary air passage for controlling the quantity of supplementary air being supplied to the engine through the auxiliary air passage and the intake passage, fuel is supplied to the engine in amounts dependent on operating conditions of the engine, in synchronism with generation of pulses of a control signal indicative of predetermined crank angles of the engine. The method is characterized by comprising the steps of: (1) detecting pressure in the intake passage downstream of the throttle valve and pressure in the intake passage upstream of the throttle valve; (2) setting a predetermined reference pressure value dependent on the detected value of the pressure of the intake passage upstream of the throttle valve; (3) comparing the detected value of the pressure of the intake passage downstream of the throttle valve with the predetermined reference pressure value; (4) detecting a value of the opening area of the throttle valve and a value of the opening area of the at least one control valve when the detected value of the pressure of the intake passage downstream of the throttle valve assumes a value indicative of smaller load on the engine with respect to the predetermined reference pressure value; (5) determining a value of a first coefficient on the basis of the detected value of the opening area of the throttle valve; (6) determining a value of a second coefficient on the basis of the detected value of the opening area of the at least one control valve; (7) detecting the interval of time between generation of a preceding pulse of the control signal and generation of a present pulse of same; (8) determining a desired amount of fuel to be supplied to the engine on the basis of a sum of the values of the first and second coefficients determined at the steps (5) and (6) and the detected value of the interval of time between generation of the preceding pulse of the control signal and generation of the present pulse of same determined at the step (7); (9) determining a correction value on the basis of a difference between the detected value of the opening area of the throttle valve and an actual value of the opening area thereof and a difference between the detected value of the opening area of the at least one control valve and an actual value of the opening area thereof; (10) correcting the desired amount of fuel determined at the step (8) by the correction value; and (11) supplying the engine with the desired amount of fuel thus corrected.

Preferably, the step (8) comprises determining the desired amount of fuel on the basis of a product value obtained by multiplying a sum of the values of the first and second coefficients by the detected value of the interval of time between generation of the preceding pulse of the control signal and generation of the present pulse of same.

Still preferably, the step (9) comprises detecting the rotational speed of the engine, determining a second desired amount of fuel on the basis of the detected value of the rotational speed of the engine and the detected value of the pressure of the intake passage downstream of the throttle valve obtained at the step (1), determining a provisional correction value from the first-mentioned desired amount of fuel obtained at the step (8) and the second desired amount of fuel, in synchronism with generation of pulses of the control signal, determining a mean value of the provisional correction values thus obtained, and employing said mean value as said correction value.

Preferably, the step (9) alternatively comprises determining the correction value on the basis of an output voltage from a variable voltage-creating means which is humanly adjustable.

Also preferably, the desired amount of fuel determined at the step (8) is corrected by a product value obtained by multiplying the correction value by the detected value of the interval of time between generation of the preceding pulse of the control signal and generation of the present pulse of same, obtained at the step (7).

The above and other objects, features and advantages of the invention will be more apparent from the ensuing detailed description taken in conjunction with the accompanying drawings.

DETAILED DESCRIPTION

The present invention will now be described in detail with reference to the drawings showing embodiments thereof.

Figure 1:
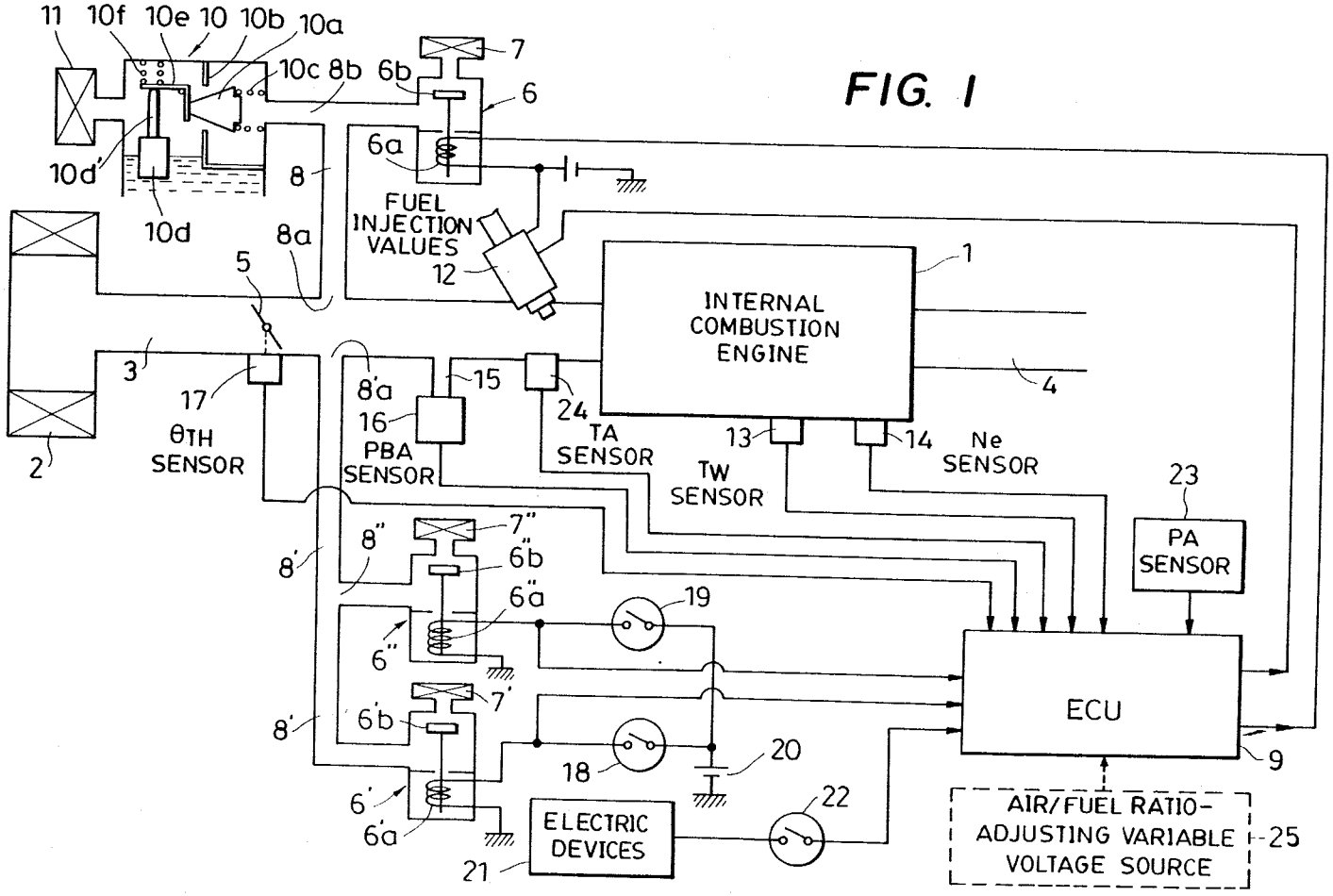
FIG. 1 is a block diagram of the whole arrangement of a fuel injection control system as an operation control means for internal combustion engines, to which is applied the method according to the present invention.

FIG. 1 schematically illustrates the whole arrangement of a fuel injection control system for internal combustion engines, which is equipped with a plurality of control valves for controlling the quantity of supplementary air being supplied to the engine. In the figure, reference numeral 1 designates an internal combustion engine which may be a four-cylinder type. Connected to the engine 1 are an intake pipe 3 with its air intake end provided with an air cleaner 2 and an exhaust pipe 4. Arranged in the intake pipe 3 is a throttle valve 5. A first air passage 8 and a second air passage 8' both open in the intake pipe 3 at a downstream side of the throttle valve 5 and communicate with the atmosphere. The first air passage 8 has an air cleaner 7 provided at an end thereof opening in the atmosphere. Arranged across the first air passage 8 is a first supplementary air quantity control valve (hereinafter merely called "the first control valve") 6 which is a normally closed type electromagnetic valve comprising a solenoid **6*a* and a valve body 6*b* disposed to open the first air passage 8 when the solenoid 6*a* is energized, the solenoid 6*a* being electrically connected to an electronic control unit (hereinafter abbreviated as "the ECU") 9**.

A third air passage 8'' branches off from the second air passage 8'. The second air passage 8' and the third air passage 8'' have air cleaners 7' and 7'' provided at their respective ends opening in the atmosphere. A second supplementary air quantity control valve (hereinafter called the second control valve) 6' is arranged across the second air passage 8' at a location between its junction with the third air passage 8'' and its end opening in the atmosphere, and a third supplementary air quantity control valve (hereinafter called "the third control valve") 6'' across the third air passage 8'', respectively. These second and third control valves 6' and 6'' are both normally closed type electro-magnetic valves having similar structures to the first control valve 6. The control valves 6', 6'' each have a solenoid **6'*a*, 6''*a*, and a valve body 6'*b*, 6''*b* disposed to open its associated air passage when its corresponding solenoid 6'*a*, 6''*a* is energized. Each of the solenoids 6'*a*, 6''*a* of the control valves 6', 6'' has one end grounded and the other end connected to a direct current power source 20 by way of a switch 18, 19, as well as to the ECU 9**.

A branch passage **8*b* branches off from the first air passage 8 at a location downstream of the first control valve 6 and has an air cleaner 11 provided at its end opening in the atmosphere. Arranged across the branch passage 8*b* is a fast idling control device 10 which may comprise, as illustrated, a valve body 10*a* disposed to be urged toward its valve seat 10*b* by the force of a spring 10*c* to thereby close the branch passage 8*b*, a sensor means 10*d* responsive to the temperature of engine cooling water to stretch or contract its arm 10*d'*, and a lever 10*e* pivotable in response to the stretch and contraction of the arm 10*d'* to cause displacement of the valve body 10*a*** in its closing or opening direction.

Fuel injection valves 12 and an intake air temperature (TA) sensor 24 are arranged in the intake pipe 3 at a location between the engine 1 and the open end **8*a* of the first air passage 8 and the open end 8'*a* of the second air passage 8'. An intake pipe absolute pressure (PBA) sensor 16 communicates through a pipe 15 with the interior of the intake pipe 3 at a location between the engine 1 and the open ends 8*a*, 8'*a*. The fuel injection valves 12 are connected to a fuel pump, not shown, and also electrically connected to the ECU 9, while the absolute pressure (PBA) sensor 16 and the intake air temperature (TA) sensor 24 are electrically connected to the ECU 9. A throttle valve opening (θTH) sensor 17 is operatively connected to the throttle valve 5, and an engine cooling water temperature (TW) sensor 13 is mounted on the main body of the engine 1. The latter sensor 13 may comprise a thermistor for instance, and may be inserted into the peripheral wall of an engine cylinder having its interior filled with cooling water, of which an output signal indicative of a detected cooling water temperature value is supplied to the ECU 9**.

An engine speed sensor (hereinafter called "the Ne sensor") 14 is disposed around a camshaft, not shown, of the engine or a crankshaft, not shown, of same and adapted to generate a pulse as a top-dead-center (TDC) signal at each predetermined crank angle position of the crankshaft each time the crankshaft rotates through 180 degrees, the generated pulse being supplied to the ECU 9.

In FIG. 1, reference numeral 21 designates electrical devices such as headlamps, a brake lamp, and an electric motor for driving a radiator cooling fan, which are electrically connected to the ECU 9 by way of switches 22. Reference numeral 23 designates an atmospheric pressure (PA) sensor, of which an output signal indicative of a detected atmospheric pressure value is supplied to the ECU 9.

The fuel injection control system constructed as above operates as follows: First, the switch 18, which is operatively connected to an air conditioner switch, not shown, for turning on and off an air conditioner, supplies a signal indicative of an on state of the air conditioner to the ECU 9 when it is closed in response to turning-on of the air conditioner. At the same time, the closed switch 18 causes energization of the solenoid **6'*a* of the second control valve 6' to open the valve body 6'*b* so that a predetermined quantity of supplementary air is supplied to the engine 1**, which corresponds to an increase in the engine load caused by the operation of the air conditioner during idle of the engine. The switch 19, which may be mounted on a shift lever, not shown, of an automatic transmission provided in the engine 1, is closed to supply an on-state signal (hereinafter called "the D-range signal") indicative of engagement of the automatic transmission when the shift lever is operated to a position of engagement of the automatic transmission. At the same time, the closed switch 19 causes energization of the solenoid 6''a of the third control valve 6'' to open the valve body 6''b so that a predetermined quantity of supplementary air is supplied to the engine 1, which corresponds to an increase in the engine load caused by the engagement of the automatic transmission during idle of the engine.

As stated above, the second control valve and the third control valve are provided, respectively, for the air conditioner and the automatic transmission which are auxiliary mechanical apparatuses directly driven by the engine and create relatively large mechanical loads applied upon the engine, so as to maintain the engine speed during idle at a substantially constant value even upon application of one or both of these large loads on the engine.

The fast idling control device 10 is adapted to operate when the engine cooling water temperature is lower than a predetermined value (e.g. 50° C.) such as at the start of the engine in cold weather. More specifically, the sensor means 10d stretches or contracts its arm 10d' in response to the engine cooling water temperature. This sensor means may comprise any suitable sensing means, such as wax filled within a casing, which is thermally expandable. When the engine cooling water temperature is lower than the above predetermined value, the arm 10d' is in a contracted state, with the lever 10e biased by the force of the spring 10f in such a direction as to displace the valve body 10a in a rightward direction as viewed in FIG. 1 against the force of the spring 10c whereby the branch passage 8b is opened. Since the open branch passage 8b allows supply of a sufficient amount of supplementary air to the engine through the filter 11 and the passages 8b, 8, the engine speed can be maintained at a higher value than a normal idling speed, thereby ensuring stable idling operation of the engine without the possibility of engine stall in cold weather.

As the arm 10d' of the sensor means 10d is stretched with a thermal expansion of the sensing medium caused by an increase in the engine cooling water temperature while the engine is warmed up, it pushes the lever 10e upward as viewed in FIG. 1 to rotate same in the clockwise direction. Then, the valve body 10a is moved leftward as viewed in FIG. 1, rather by the force of the spring 10c. When the engine cooling water temperature exceeds the predetermined value, the valve body 10a comes into urging contact with the valve seat 10b to close the branch passage 8b, thereby interrupting the supply of supplementary air through the fast idling control device 10.

On the other hand, the first control valve 6 is used for feedback control of the supplementary air quantity wherein the same quantity is varied so as to maintain the engine speed at a desired idling speed with accuracy. Also, it is used for increasing the amount of supplementary air by a predetermined amount corresponding to electrical load on the engine, which is relatively small, when one or more of the electrical devices 21 such as the headlamps, the brake lamp and the electric motor for driving the radiator cooling fan are switched on. To be specific, the ECU 9 operates on values of various signals indicative of operating conditions of the engine supplied from the throttle valve opening (θTH) sensor 17, the absolute pressure (PBA) sensor 16, the cooling water temperature (TW) sensor 13, the engine speed (Ne) sensor 14 and the atmospheric pressure (PA) sensor 23, as well as an electrical load signal supplied from the electrical devices 21 and in synchronism with generation of pulses of the TDC signal supplied from the Ne sensor 14, to determine whether or not the engine is in an operating condition requiring the supply of supplementary air through the first control valve 6, and also set a desired idling speed value. When it is determined that the engine is in such an operating condition requiring the supply of supplementary air, the ECU 9 calculates a value of supplementary air quantity to be supplied to the engine, that is, a valve opening duty ratio DOUT for the first control valve 6, in response to the difference between the actual engine speed value and the determined desired idling speed value so as to minimize the same difference, and supplies a driving signal corresponding to the calculated duty ratio value, to the first control valve 6 to operate same.

The first control valve 6 has its solenoid 6a energized for a valve opening period corresponding to the above calculated duty ratio DOUT to open the first air passage 8 so that a required quantity of supplementary air corresponding to the valve opening period of the valve 6 is supplied to the engine 1 through the first air passage 8 and the intake pipe 3.

On the other hand, the ECU 9 also operates on values of the aforementioned various engine operating parameter signals and in synchronism with generation of pulses of the TDC signal to calculate the fuel injection period TOUT for the fuel injection valves 12 by the use of the following equation:

$$TOUT = Ti \times K1 + K2 \quad (1)$$

where Ti represents a basic fuel injection period, which is determined according to the aforementioned SD method or the KMe method, depending upon whether or not the engine is operating in an operating region wherein a predetermined idling condition is fulfilled, as hereinafter described in detail.

In the above equation, K1 and K2 represent correction coefficients or correction variables which are calculated on the basis of values of engine operating parameter signals supplied from the aforementioned various sensors such as the throttle valve opening (θTH) sensor 17, the atmospheric pressure (PA) sensor 23, the intake air temperature (TA) sensor 24. For instance, the correction coefficient K1 is calculated by the use of the following equation:

$$K1 = KTA \times KPA \times KTW \times KWOT \quad (2)$$

where KTA represents an intake air temperature-dependent correction coefficient, and KPA an atmospheric pressure-dependent correction coefficient, respectively. These correction coefficients KTA and KPA are determined by the use of respective predetermined equations selectively applied in response to the method to be applied, i.e. the SD method or the KMe method, so as to set the coefficients KTA, KPA at values most appropriate to the SD method or the KMe method, as hereinafter described in detail.

In the above equation (2), KTW represents a coefficient for increasing the fuel supply quantity, which has its value determined in dependence on the engine cooling water temperature TW sensed by the engine cooling water temperature (TW) sensor 13, and KWOT a mixture-enriching coefficient applicable at wide-open-throttle operation of the engine and having a constant value, respectively.

The ECU 9 supplies the fuel injection valves 12 with driving signals corresponding to the fuel injection period TOUT calculated as above, to open the same valves.

Figure 2:
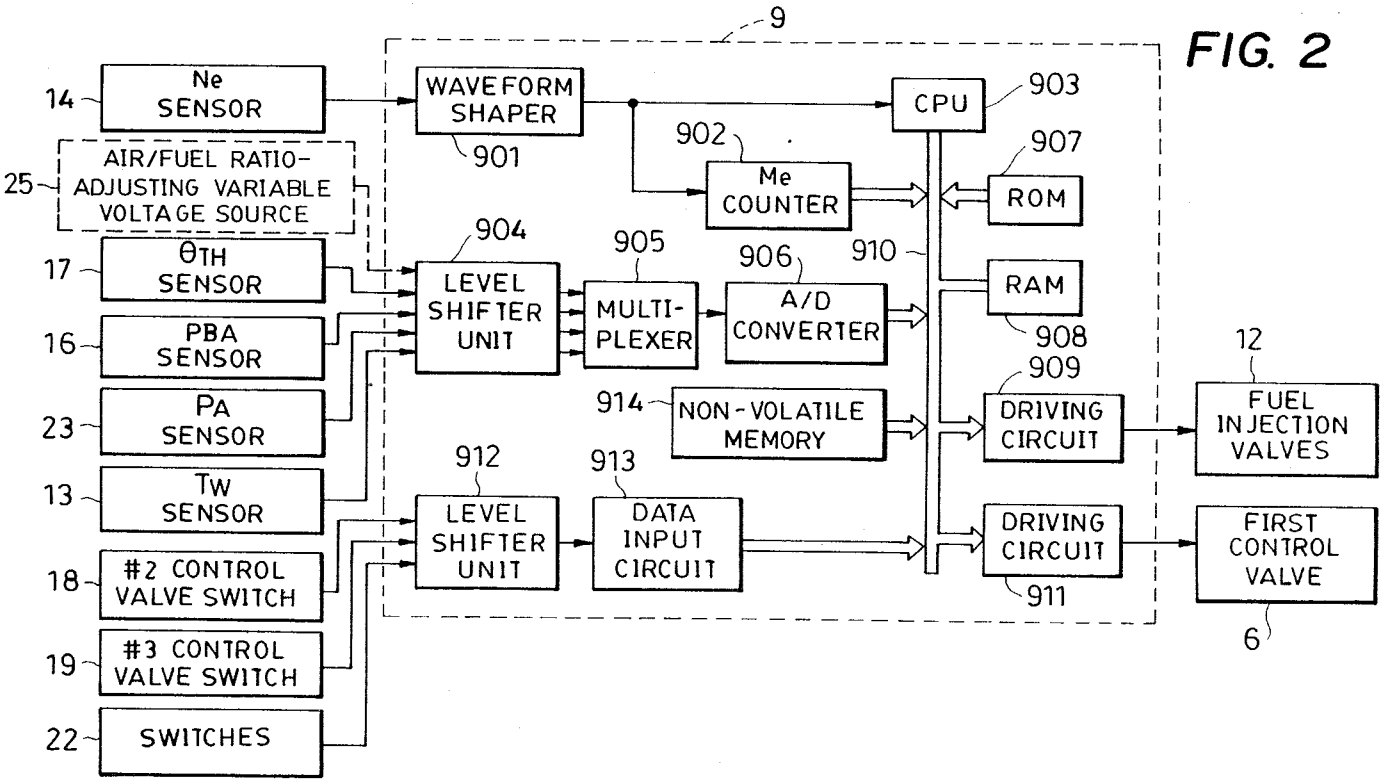
FIG. 2 is a circuit diagram of the interior construction of an electronic control unit (ECU) appearing in FIG. 1.

FIG. 2 shows a circuit configuration within the ECU 9 in FIG. 1. An output signal from the engine speed (Ne) sensor 14 is applied to a waveform shaper 901, wherein it has its pulse waveform shaped, and supplied to a central processing unit (hereinafter called "the CPU") 903, as the TDC signal, as well as to an Me value counter 902. The Me value counter 902 counts the interval of time between a preceding pulse of the TDC signal and a present pulse of same, inputted thereto from the Ne sensor 14, and therefore its counted value Me is proportional to the reciprocal of the actual engine speed Ne. The Me value counter 902 supplies the counted value Me to the CPU 903 via a data bus 910.

The respective output signals from the throttle valve opening ($\theta$TH) sensor 17, the intake pipe absolute pressure (PBA) sensor 16, the engine cooling water temperature (TW) sensor 13, the atmospheric pressure (PA) sensor 23, and the intake air temperature (TA) sensor 24 appearing in FIG. 1 have their voltage levels shifted to a predetermined voltage level by a level shifter unit 904 and successively applied to an analog-to-digital converter 906 through a multiplexer 905. The analog-to-digital converter 906 successively converts into digital signals analog output voltages from the aforementioned various sensors, and the resulting digital signals are supplied to the CPU 903 via the data bus 910.

On-off state signals supplied from the switch 18 for opening the second control valve 6' during operation of the air conditioner, the switch 19 for opening the third control valve 6'' during engagement of the automatic transmission, and the switches 22 for the electrical devices 21, all appearing in FIG. 1, are supplied to another level shifter unit 912 wherein the signals have their voltage levels shifted to a predetermined voltage level, and the level shifted signals are processed by a data input circuit 913 and applied to the CPU 903 through the data bus 910.

Further connected to the CPU 903 via the data bus 910 are a read-only memory (hereinafter called "the ROM") 907, a random access memory (hereinafter called "the RAM") 908, a non-volatile memory 914 and driving circuits 909 and 911. The RAM 908 temporarily stores various calculated values from the CPU 903, while the ROM 907 stores a control program executed within the CPU 903, etc. The non-volatile memory 914 comprises a CMOS for instance, and stores values of an air/fuel ratio correction coefficient KIDL applicable to calculation of the basic fuel injection period Ti according to the KMe method. These stored values are retained in the memory 914 without being erased even if the ignition switch, not shown, of the engine is turned off.

The CPU 903 executes the control program stored in the ROM 907 to determine operating conditions of the engine from the values of the aforementioned various engine operating parameter signals and the on-off state signals from the switches 18, 19 and 22 to calculate the valve opening duty ratio DOUT for the first control valve 6 and also calculate the fuel injection period TOUT for the fuel injection valves 12 in accordance with the determined operating conditions of the engine in a manner hereinafter described in detail, and supplies control signals corresponding to the resulting calculated values to the driving circuits 911 and 909 through the data bus 910. The driving circuits 911, 909 supply driving signals to the first control valve 6 and the fuel injection valves 12, respectively, to open same as long as they are supplied with the respective control signals.

Figure 3:
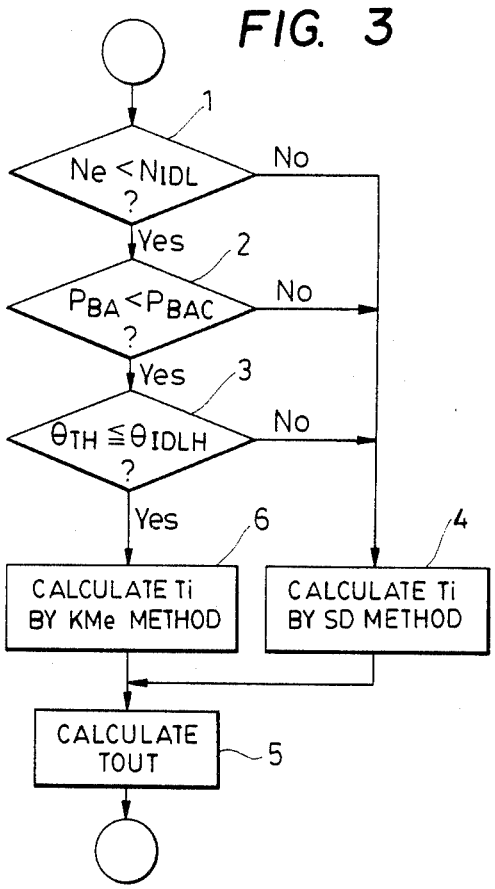
FIG. 3 is a flowchart of a program executed within the ECU for calculating a fuel injection period TOUT.
Figure 4:
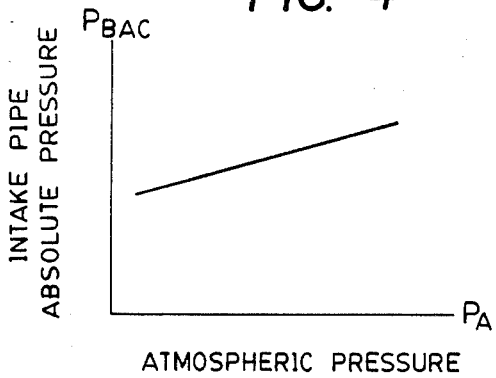
FIG. 4 is a graph showing the relationship between a reference value PBAC of intake pipe absolute pressure and atmospheric pressure PA.

FIG. 3 shows a flowchart of a program for calculating the valve opening period TOUT of the fuel injection valves 12, which is executed within the CPU 903 in FIG. 2. First, the steps 1 through 3 in FIG. 3 are executed to determine whether or not the aforementioned predetermined idling condition of the engine is fulfilled. At the step 1, a determination is made as to whether or not the engine rotational speed Ne is below a predetermined value NIDL (e.g. 1000 rpm). If the determination provides a negative result (no), it is regarded that the predetermined idling condition is not fulfilled, and the program jumps to the step 4, hereinafter referred to. If the answer to the question of the step 1 is yes, the program proceeds to the step 2 wherein it is determined whether or not the intake pipe absolute pressure PBA is on the lower engine load side with respect to a predetermined reference value PBAC, that is, whether or not the former is lower than the latter. This predetermined reference pressure value PBAC is set at such a value as to determine whether or not the ratio (PBA/PA') of the absolute pressure PBA in the intake pipe 3 downstream of the throttle valve 5 to the absolute pressure PA' in the intake pipe upstream of the throttle valve 5 is lower than a critical pressure ratio (=0.528) at which the flow velocity of intake air passing the throttle valve 5 is equal to the velocity of sound. The reference pressure value PBAC is given by the following equation:

$$PBAC = PA' \times (\text{critical pressure ratio}) \quad (3)$$

$$= PA' \times [2/(n+1)]^{\frac{n}{n-1}} \approx 0.528 \times PA$$

where n represents the ratio of specific heat of air (=1.4). Since the absolute pressure PA' in the intake pipe 3 upstream of the throttle valve 5 is approximate or substantially equal to the atmospheric pressure PA sensed by the atmospheric pressure (PA) sensor 23 in FIG. 1, the relationship of the above equation (3) can stand. The relationship between the reference pressure PBAC and the atmospheric pressure PA, given by the equation (3), is shown in FIG. 4.

Referring again to FIG. 3, if the answer to the question of the step 2 is negative or no, it is regarded that the predetermined idling condition is not fulfilled, and the program proceeds to the step 4, whereas if the answer is yes, the step 3 is executed. In the step 4, a determination is made as to whether or not the valve opening $\theta$TH of the throttle valve 5 is smaller than a predetermined value $\theta$IDLH. This determination is necessary for the following reason: In the event that the engine operating condition shifts from an idling condition wherein the throttle valve 5 is almost closed to an accelerating condition wherein the throttle valve is suddenly opened from the almost closed position, if this transition to the accelerating condition is detected solely from changes in the engine rotational speed and the intake pipe absolute pressure as in the aforementioned steps 1 and 2, there is a delay in the detection due to the response lag of the absolute pressure sensor 16. Therefore, a change in the valve opening of the throttle valve 5 is utilized for quick detection of such accelerating condition. If the engine is thus determined to have entered an accelerating condition, a required quantity of fuel should be calculated according to the SD method for supply to the engine.

If the answer to the question of the step 3 is negative or no, it is regarded that the predetermined idling condition is not satisfied, and then the steps 4 is executed, while if the answer is yes, the step 6 is executed.

At the step 4 which is executed when the idling condition is not satisfied, a calculation is carried out of the basic fuel injection period value Ti according to the SD method. That is, a value of the basic fuel injection period Ti is read from the ROM 907 in the CPU 9, which corresponds to the detected values of the intake pipe absolute pressure PBA and the engine speed Ne. The basic fuel injection period Ti value thus determined is then applied to the aforementioned equation (1) for calculating the fuel injection period TOUT (the step 5).

On the other hand, at the step 6 which is executed when the idling condition is fulfilled, the basic fuel injection period Ti is calculated according to the KMe method, as hereinafter described in detail, and the determined basic fuel injection period Ti value is then applied for calculation of the fuel injection period TOUT (the step 5).

In the above steps 1 through 3, the respective predetermined parameter values for determining the predetermined idling condition of the engine may each be set at different values between entrance of the engine operation into a region in which the predetermined idling condition is fulfilled and departure therefrom, so that a hysteresis characteristic is imparted to changeover from the KMe method to the SD method or vice versa, thereby achieving stable control of operation of the engine.

Figure 5:
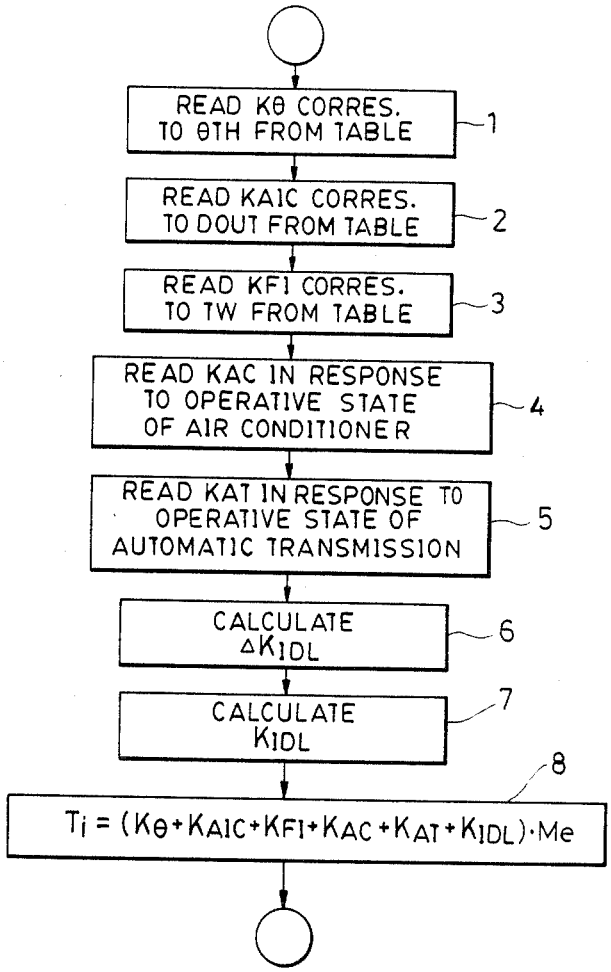
FIG. 5 is a flowchart showing a manner of determining a basic fuel injection period Ti value according to the KMe method, which is executed at the step 6 in FIG. 3.
Figure 6:
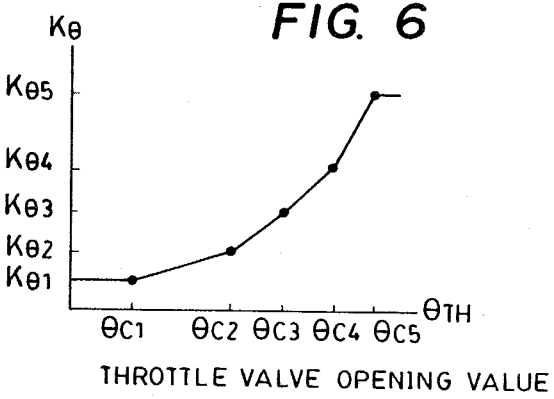
FIG. 6 is a graph showing a table of the relationship between a coefficient Kθ dependent on the valve opening area of the throttle valve and the throttle valve opening θTH.

FIG. 5 shows a manner of determining the basic fuel injection period Ti value according to the KMe method, which is executed at the step 6 in FIG. 3. In FIG. 5, the step 1 is provided to determine the value of a coefficient $K\theta$ dependent on the valve opening area of the throttle valve 5. The same coefficient value $K\theta$ is determined from a graph or a table in FIG. 6, of the relationship between the throttle valve opening $\theta TH$ and the opening area coefficient $K\theta$. As a practical measure for realizing this, for instance, the ROM 907 in the ECU 9 stores beforehand predetermined values $K\theta 1$ through $K\theta 5$ as the value $K\theta$ corresponding, respectively, to predetermined throttle valve opening values $\theta c1$ through $\theta c5$. Two adjacent $K\theta$ values substantially corresponding to the actual throttle valve opening $\theta TH$ are read from the ROM 907 and subjected to interpolation to determine a coefficient value $K\theta$ exactly corresponding to the actual throttle valve opening value $\theta TH$.

Figure 7:
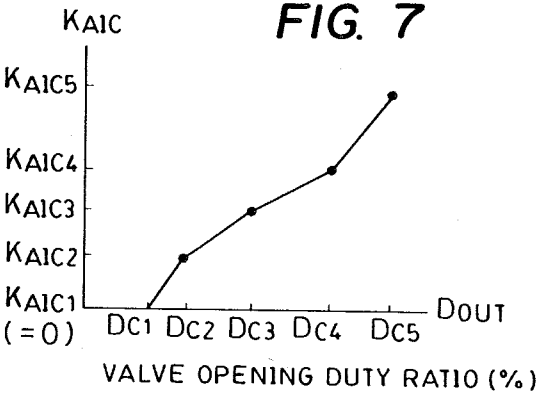
FIG. 7 is a graph showing a table of the relationship between a coefficient KAIC dependent on the valve opening area of a first control valve appearing in FIG. 1, and the valve opening duty ratio DOUT for the same control valve.

Next, in the step 2 of FIG. 5, the value of a coefficient KAIC is determined, which is dependent upon the valve opening area of the first control valve 6. The valve opening area of the first control valve 6 and accordingly the value KAIC can be determined as a function of the valve opening duty ratio DOUT. FIG. 7 shows a table of the relationship between the valve opening duty ratio DOUT of the first control valve 6 and the valve opening area coefficient KAIC thereof. In the same manner as the above-described manner of determining the valve opening area coefficient value $K\theta$ of the throttle valve can be determined the valve opening area coefficient KAIC value corresponding to the valve opening duty ratio of the first control valve 6, and accordingly corresponding to the valve opening area of same.

Figure 8:
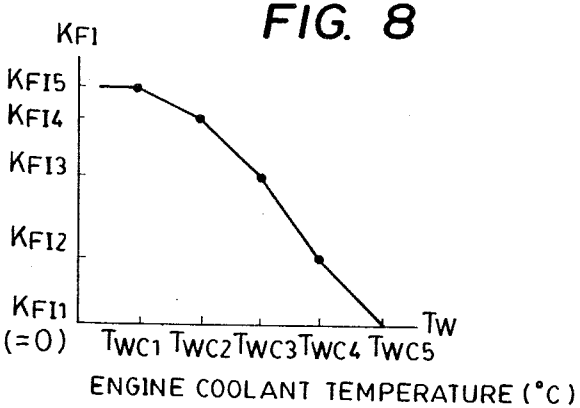
FIG. 8 is a graph showing a table of the relationship between a coefficient KFI dependent on the passage opening area of a fast idling control device appearing in FIG. 1, and engine cooling water temperature TW.

The step 3 in FIG. 5 is provided to determine the value of a passage opening area coefficient KFI dependent on the passage opening area of the fast idling control device 10 in FIG. 1. The passage opening area and accordingly the value KFI of the fast idling control device 10 can be determined as a function of the engine cooling water temperature TW. FIG. 8 shows a table of the relationship between the engine cooling water temperature TW and the passage opening area coefficient KFI. In the same manner as the aforedescribed manner of determining the valve opening area coefficient $K\theta$ of the throttle valve can be determined the passage opening area coefficient KFI value of the fast idling control device 10.

In the step 4, the value of a coefficient KAC is determined, which is dependent on the valve opening area of the second control valve 6'. Since the second control valve 6' is disposed to be fully opened or fully closed in response to on- and off-states of the switch 18 operable in response to operation of the air conditioner switch, a predetermined coefficient KAC value corresponding to a value of the valve opening area of the second control valve 6' in fully open position is read from the ROM 907 when the switch 18 is in an on or closed state.

The step 5 is executed only in the event that the method of the present invention is applied to an internal combustion engine equipped with an automatic transmission. When the third control valve 6'' is fully opened by a signal indicative of the on-state of the switch 19 representing engagement of the automatic transmission, a predetermined value KAT corresponding to a value of the valve opening area of the third control valve 6'' in fully open position is read from the ROM 907.

The CPU 903 then executes the steps 6 and 7 to calculate values of correction coefficients ΔKIDL and KIDL according to the first embodiment of the invention. These correction coefficient values are determined by using equations given hereinbelow:

Assuming that the intake pipe absolute pressure PBA is detected with accuracy without being disturbed by pulsation thereof, a valve opening period TOUT1 of the fuel injection valves 12 can be determined by using the following equation according to the SD method, if corrections dependent on atmospheric pressure and intake air temperature alone are taken into consideration:

$$TOUT1 = TiMAP \times KPA1 \times KTA1 \quad (4)$$

where TiMAP represents a basic fuel injection period which is read from a Ti map stored in the ROM 907 in FIG. 2 as a function of the intake pipe absolute pressure PBA sensed by the intake pipe absolute pressure sensor 16 in FIG. 1 and the engine speed Ne sensed by the Ne sensor. KPA1 is an atmospheric pressure-dependent correction coefficient applicable to the SD method, which is determined by the following equation, as disclosed e.g. in Japanese Provisional Patent Publication No. 58-85337:

$$KPA1 = \frac{1 - (1/\epsilon)(PA/PBA)^{1/\kappa}}{1 - (1/\epsilon)(PA0/PBA)^{1/\kappa}} \quad (5)$$

where PA represents actual atmospheric pressure (absolute pressure), PA0 standard atmospheric pressure, $\epsilon$ the compression ratio, and n the ratio of specific heat of air, respectively. Calculation of the atmospheric pressure-dependent correction coefficient KPA1 value by the use of the above equation (5) is based upon the recognition that the quantity of air being sucked into the engine per suction cycle of same can be theoretically determined from the intake pipe absolute pressure PBA and the absolute pressure in the exhaust pipe which can be regarded as almost equal to the atmospheric pressure PA, and the fuel supply quantity may be varied at a rate equal to the ratio of the intake air quantity at the actual atmospheric pressure PA to the intake air quantity at the standard atmospheric pressure PA0.

When the relationship PA<PA0 stands in the equation (5), the KPA1 value of the atmospheric pressure-dependent coefficient KPA is larger than 1. So long as the intake pipe absolute pressure PBA remains the same, the quantity of intake air being sucked into the engine becomes larger at a high altitude where the atmospheric pressure PA is lower than the standard atmospheric pressure PA0, than at a lowland. Therefore, if the engine is supplied with a fuel quantity determined as a function of the intake pipe absolute pressure PBA and the engine rotational speed Ne in a low atmospheric pressure condition such as at high altitudes, it can result in a lean air/fuel mixture. However, such leaning of the mixture can be avoided by employing the above fuel increasing coefficient KPA1 value.

On the other hand, the value of the intake air temperature-dependent correction coefficient KTA1 applicable to the SD method is given in the following manner, as disclosed in U.S. Pat. No. 4,465,051:

$$KTA1 = \frac{1}{1 + CTAMAP(TA - TA0)} \quad (6)$$

where TA represents the temperature (°C.) of intake air flowing in the intake pipe, and TA0 a calibration variable, which is set e.g. to 50° C., respectively. CTAMAP represents a calibration coefficient having its value set to a constant value (e.g. $1.26\times10^{-3}$) in dependence upon the operating characteristics of the engine. In the above equation (6), since the value of CTAMAP(TA−TA0) is smaller than 1, the coefficient KTA1 can be approximately determined by the following equation:

$$KTA1 = 1 - CTAMAP(TA - TA0) \quad (7)$$

On the other hand, a valve opening period TOUT2 of the fuel injection valves 12 applicable to the KMe method can be determined by the use of the following equation, if corrections dependent on atmospheric pressure and intake air temperature alone are taken into account as in the above manner:

$$TOUT2 = (K\theta + KAIC + KFI + KAC + KAT) \times Me \times KPA2 \times KTA2 \quad (8)$$

where K$\theta$, KAIC, etc. represent opening area-dependent coefficients having their values determined at the steps 1 through 5 in FIG. 5, and Me the interval of time between adjacent pulses of the TDC signal, which is supplied from the Me value counter 902 in FIG. 2, respectively. KPA2 and KTA2 represent an atmospheric pressure-dependent correction coefficient and an intake air temperature-dependent correction coefficient, respectively, applicable to the KMe method and determined as follows:

When the ratio (PBA/PA') of intake pipe pressure PBA downstream of the throttling portion such as the throttle valve to intake pipe pressure PA' upstream of the throttling portion is smaller than the critical pressure ratio (=0.528), intake air passing the throttling portion forms a sonic flow. The flow rate Ga(g/sec) of intake air can be expressed as follows:

$$Ga = A \times C \times PA \times \sqrt{\left(\frac{2}{n+1}\right)^{\frac{n+1}{n-1}} \times \frac{gn}{R(TAF + 273)}} \quad (9)$$

where A represents the equivalent opening area (mm$^2$) of the throttling portion such as the throttle valve, C a correction coefficient having its value determined by the configuration, etc. of the throttling portion, PA atmospheric pressure (PA≈PA', mmHg), n the ratio of specific heat of air, R the gas constant of air, TAF the temperature (°C.) of intake air immediately upstream of the throttling portion, and g the gravitational acceleration (m/sec$^2$), respectively. So long as the intake air temperature TAF and the opening area A remain constant, the ratio of the flow rate of intake air Ga (in gravity or weight) under the actual atmospheric pressure PA to the flow rate of intake air Ga0 (in gravity or weight) under the standard atmospheric pressure PA0 can be expressed as follows:

$$Ta/Ga0 = PA/PA0$$

If the quantity of fuel being supplied to the engine is varied at a rate equal to the above ratio of flow rate of intake air, the resulting air/fuel ratio is maintained at a constant value. Therefore, the flow rate Gf of fuel can be determined from the flow rate Gf0 of same under the standard atmospheric pressure PA0 (=760 mmHg), as expressed by the following equation:

$$Gf = Gf0 \times \frac{PA}{760}$$

Here, the atmospheric pressure-dependent correction coefficient KPA2 value can be theoretically expressed as follows:

$$KPA2 = PA/760$$

In practice, however, various errors resulting from configuration, etc. of the intake passage should be taken into account, and therefore the above equation can be expressed as follows:

$$KPA2 = 1 + CPA \times \frac{PA - 760}{760} \quad (10)$$

where CPA represents a calibration variable which is determined experimentally.

According to the equation (10), when the relationship PA<760 mmHg stands, the correction coefficient KPA2 value is smaller than 1. Since according to the KMe method, the quantity of intake air is determined solely from the equivalent opening area A of the throttling portion in the intake passage with reference to the standard atmospheric pressure PA0, it decreases in proportion as the atmospheric pressure PA decreases such as at a high altitude where the atmospheric pressure PA is lower than the standard atmospheric pressure PA0. Therefore, if the fuel quantity is set in dependence on the above opening area A, the resulting air/fuel mixture becomes rich, in a manner reverse to the SD method. However, such enriching of the mixture can be avoided by employing the above correction coefficient KPA2 value.

In the aforementioned equation (9), so long as the atmospheric pressure PA and the opening area A remain constant, the ratio of the flow rate Ga0 of intake air assumed when the temperature of air upstream of the throttling portion is equal to a reference temperature TAF0, to the flow rate Ga of intake air at a given temperature TAF can be given by the following equation:

$$\frac{Ga}{Ga0} = \sqrt{\frac{TAF0 + 273}{TAF + 273}}$$

If the quantity of fuel being supplied to the engine is varied at a rate equal to the above ratio of flow rate of intake air, the resulting air/fuel ratio is maintained at a constant value. Therefore, the flow rate Gf of fuel can be determined from the flow rate Gf0 of same at the reference temperature TAF0, as expressed by the following equation:

$$Gf = Gf0\sqrt{\frac{TAF0 + 273}{TAF + 273}}$$

Here, the intake air temperature-dependent correction coefficient KTA2 value can be expressed as follows:

$$KTA2 = \sqrt{\frac{TAF0 + 273}{TAF + 273}}$$

Therefore, the correction coefficient KTA2 value can be approximated by the following equation:

$$KTA2 \approx 1 - \frac{TAF - TAF0}{2(TAF + 273)} \approx 1 - \alpha(TAF - TAF0) \quad (11)$$

Thus, the above correction coefficient KTA2 value is determined as a function of the temperature TAF of intake air upstream of the throttling portion. It has been experimentally ascertained that the functional relationship between the intake air temperature TAF upstream of the throttling portion and the intake air temperature TA downstream of same is approximated by the following equation, when the engine is in an idling condition:

$$TAF = a \times TA + b \quad (12)$$

where a and b represent constants. Taking the relationship of $TAF0 = a \times TA0 + b$ into consideration, the equation (11) can be expressed as follows, by substituting the equation (12) into the equation (11):

$$\begin{aligned} KTA2 &= 1 - a \times \alpha(TA - TA0) \\ &= 1 - CTAC(TA - TA0) \end{aligned} \quad (13)$$

Thus, the intake air temperature-dependent correction coefficient KTA2 value can be given by the simplified equation (13).

The valve opening periods TOUT1 and TOUT2 of the fuel injection valves 12, which have thus been corrected by the respective atmospheric pressure-dependent correction coefficients and the respective intake air temperature-dependent correction coefficents appropriate to the SD method and the KMe method, respectively, should assume the same value with each other, if pulsation is not present in the intake pipe absolute pressure PBA. In practice, however, the valve opening periods TOUT1 and TOUT2 generally assume different values from each other, because the valve opening period TOUT1 determined by the equation (4) according to the SD method is affected by pulsation in the intake pipe absolute pressure PBA, whereas the valve opening period TOUT2 determined by the equation (8) according to the KMe method is affected by locating error at installation of the throttle valve opening sensor 17, clogging of the air cleaners 2, 7, 7', 7'', etc. Therefore, the correction coefficient ΔKIDL, which is set to a value dependent on errors due to pulsation in the intake pipe absolute pressure PBA, locating error of the throttle valve opening sensor 17, etc., is applied to the equation (8), thus obtaining a corrected valve opening period value TOUT2':

$$TOUT2' = (K\theta + KAIC + KFI + KAC + KAT + \Delta KIDL) \times Me \times KPA2 \times KTA2 \quad (14)$$

Since the valve opening period TOUT1 and TOUT2' values determined from the equations (4) and (14), respectively, are equal to each other, the correction coefficient ΔKIDL can be expressed as follows:

$$\Delta KIDL = \frac{TiMAP \times KPA1 \times KTA1}{Me \times KPA2 \times KTA2} - (K\theta + KAIC + KFI + KAC + KAT) \quad (15)$$

Then, each value of the correction coefficient ΔKIDL, which is determined upon generation of each pulse of the TDC signal by the use of the equation (15), is substituted into the following equation, to calculate a mean value of coefficient ΔKIDL values as a correction coefficient KIDL value:

$$KIDL = \frac{XIDL}{256} \times \Delta KIDL + \frac{256 - XIDL}{256} \times KIDL' \quad (16)$$

where KIDL' represents a correction coefficient KIDL value which was determined upon generation of an immediately preceding pulse of the TDC signal and is read from the non-volatile memory 914 in FIG. 2. XIDL is a constant which is set at a value dependent on the period of pulsation of the intake pipe absolute pressure PBA, etc. and appropriately selected from among values of 1 to 256.

The manner of determining the mean value of the correction coefficient ΔKIDL is not limited to the above manner using the equation (16), but the mean value may alternatively be determined as an arithmetic mean value of a predetermined number of coefficient ΔKIDL values obtained upon generation of the TDC signal pulses preceding a present TDC signal pulse.

The correction coefficient KIDL value determined by the equation (16) represents errors as caused by locating error at installation of the throttle valve opening sensor 17 and clogging of the air cleaners alone, since the error components of the coefficient KIDL value due to pulsation of the intake pipe absolute pressure PBA, included in the ΔKIDL value, have been offset by each other through the averaging operation in calculating the correction coefficient value KIDL. Further, since the correction coefficient value KIDL is calculated upon generation of each pulse of the TDC signal, it assumes an updated value indicative of currently present errors due to clogging of the air cleaners, deposition of carbon in the throttle valve, etc.

The CPU 903 calculates the correction coefficient ΔKIDL value at the step 6 in FIG. 5 by using the equation (15), and then executes the step 7 to calculate the correction coefficient KIDL value from the correction coefficient ΔKIDL value calculated in the present loop and the correction coefficient value KIDL' read from the non-volatile memory 914, by the use of the equation (16), and stores the same value KIDL into the non-volatile memory 914 as an updated value KIDL', followed by execution of the step 8. At the step 8, the basic fuel injection period Ti is determined from the opening area-dependent coefficients obtained at the aforementioned steps 1 to 5, the correction coefficient KIDL obtained in the step 7 and the Me value supplied from the Me value counter 902, by the use of the following equation:

$$Ti=(K\theta+KAIC+KFI+KAC+KAT+KIDL)\times Me \qquad (17)$$

According to the first manner of calculation of the KIDL value described above, detection errors of actual valve openings of the throttle valve and the control valves, etc. can be automatically corrected without requiring human adjustment by the operator, and therefore it is not necessary to specially provide an input circuit including an air/fuel ratio-adjusting variable voltage source as hereinafter referred to, an analog-to-digital converter, etc., resulting in reduction of the production cost.

A second manner of calculating the KIDL value will now be described. As shown in FIGS. 1 and 2 an air/fuel ratio-adjusting variable voltage source 25 as a variable voltage-creating means is connected to the ECU 9 and has its output voltage humanly adjusted and then applied for setting the correction coefficient KIDL value. More specifically, the air/fuel ratio-adjusting variable voltage source 25 connected to the ECU 9 as indicated by the broken line in FIGS. 1 and 2, has its output voltage varied by human adjustment of the value of a variable resistance therein that determines the output voltage. The voltage thus adjusted is applied to the ECU 9 as an air/fuel ratio-correcting voltage VKIDL. The air/fuel ratio-correcting voltage VKIDL has its voltage level shifted by the level shifter unit 904 and then supplied to the CPU 903 via the multiplexer 905, the analog-to-digital converter 906 data bus 910. The CPU 903 reads a value of the correction coefficient KIDL corresponding to the value of the voltage VKIDL from a voltage VKIDL-correction coefficient KIDL table stored in the ROM 907. This table is illustrated, by way of exmaple, in FIG. 9, wherein as the voltage VKIDL value varies between 0.5 and 4.5 volts for instance, the correction coefficient KIDL value is varied between −0.1 and +0.1.

The CPU 903 may execute, in lieu of the program of FIG. 5 applied to the first manner of calculating the KIDL value, a Ti value-determining program which may be identical with the program of FIG. 5 but exclusive of the steps 6 and 7 therein, to calculate the basic fuel injection period Ti value by applying the correction coefficient KIDL value determined as above to the aforementioned equation (17).

The human adjustment of the variable resistance of the air/fuel ratio-adjusting variable voltage source 25 is effected at delivery of the engines from the factory or at maintenance of same, for example, so as to set the air/fuel ratio of a mixture being supplied to the engine to a predetermined value. That is, the value of the correction coefficient KIDL is set so as to compensate for errors due to variations in the performance of the throttle valve opening sensor, locating error of the same sensor, and differences in value between the actual opening areas and the detected opening areas of the throttle valve and the control valves, as caused by deposition of carbon, etc. in the valves.

Figure 9:
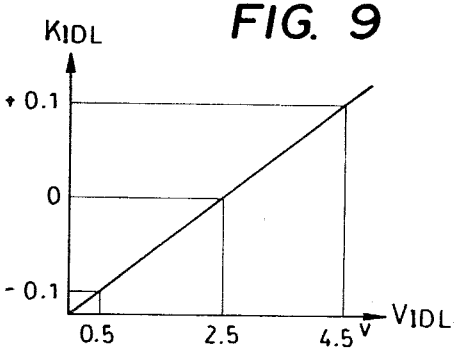
FIG. 9 is a graph showing a table of the relationship between a correction coefficient KIDL and output voltage VIDL of an air/fuel ratio adjusting variable voltage source.

Although, in the example of FIG. 9, the output voltage VKIDL of the air/fuel ratio-adjusting variable voltage source 25 is varied in a continuous manner by the use of a variable resistance for instance, it may be varied in a stepwise manner by selecting a plurality of fixed resistances.

Further, the method of the present invention is not limited to the fuel injection quantity control for the fuel injection control system, described above, but it may be applied to other operation control means for controlling the operation of the engine, such as an ignition timing control system and an exhaust gas recirculation control system, so far as the operating amounts of these systems are determined in dependence on the intake air quantity.

What is claimed is:

1. A method of controlling an operating amount of an operation control means for controlling the operation of an internal combustion engine having an intake passage and an intake air quantity control means for regulating the quantity of intake air being supplied to said engine through said intake passage by adjusting the opening area of said intake passage, wherein the operating amount of said operating control means is controlled to required values dependent on operating conditions of said engine, in synchronism with generation of pulses of a predetermined control signal, the method comprising the steps of: (1) determining whether or not said engine is operating in a predetermined low load condition; (2) detecting a value of the opening area of said intake passage, when said engine is determined to be operating in said predetermined low load condition; (3) determining a desired value of the operating amount of said operation control means on the basis of the detected value of the opening area of said intake passage; (4) determining a correction value on the basis of a difference between the detected value of the opening area of said intake passage and an actual value of same; (5) correcting the desired value of the operating amount determined at said step (3) by said correction value; and (6) controlling the operating amount of said operation control means to the desired operating amount thus corrected, wherein said step (4) comprises detecting pressure in said intake passage downstream of said intake air quantity control means, detecting the rotational speed of said engine, determining a second desired value of the operating amount on the basis of the detected value of the rotational speed of said engine and the detected value of the pressure in said intake passage, determining said correction value on the basis of a difference between the first-mentioned desired value of the operating amount obtained at said step (3) and said second desired value of the operating amount, in synchronism with generation of pulses of said predetermined control signal.

2. A method as claimed in claim 1, wherein said correction value is a mean value of provisional correction values determined on the basis of a difference between the first-mentioned desired value of the operating amount obtained at said step (3) and said second desired value of the operating amount, in synchronism with generation of pulses of said predetermined control signal.

3. A method as claimed in claim 1, wherein said operation control means comprises a fuel supply control means, said operating amount being a quantity of fuel being supplied to said engine by said fuel supply control means.

4. A method of controlling an operating amount of an operation control means for controlling the operation of an internal combustion engine having an intake passage and an intake air quantity control means for regulating the quantity of intake air being supplied to said engine through said intake passage by adjusting the opening area of said intake passage, wherein the operating amount of said operation control means is controlled to required values dependent on operating conditions of said engine, in synchronism with generation of pulses of a predetermined control signal, the method comprising the steps of: (1) determining whether or not said engine is operating in a predetermined low load condition; (2) detecting a value of the opening area of said intake passage, when said engine is determined to be operating in said predetermined low load condition; (3) determining a desired value of the operating amount of said operation control means on the basis of the detected value of the opening area of said intake passage; (4) determining a correction value on the basis of a difference between the detected value of the opening area of said intake passage and an actual value of same; (5) correcting the desired value of the operating amount determined at said step (3) by said correction value; and (6) controlling the operating amount of said operation control means to the desired operating amount thus corrected, wherein said step (4) comprises determining said correction value on the basis of an output voltage from a variable voltage-creating means which is humanly adjustable.

5. A method as claimed in claim 4, wherein said operation control means comprises a fuel supply control means, said operating amount being a quantity of fuel being supplied to said engine by said fuel supply control means.

6. A method of controlling the quantity of fuel being supplied to an internal combustion engine having an intake passage, a throttle valve arranged in said intake passage, at least one auxiliary air passage opening into said intake passage at a location downstream of said throttle valve and communicating with the atmosphere, and at least one control valve arranged in said auxiliary air passage for controlling the quantity of supplementary air being supplied to said engine through said auxiliary air passage and said intake passage, wherein fuel is supplied to said engine in amounts dependent on operating conditions of said engine, in synchronism with generation of pulses of a control signal indicative of predetermined crank angles of said engine, the method comprising the steps of: (1) detecting pressure in said intake passage downstream of said throttle valve and pressure in said intake passage upstream of said throttle valve; (2) setting a predetermined reference pressure value dependent on the detected value of the pressure of said intake passage upstream of said throttle valve; (3) comparing the detected value of the pressure of said intake passage downstream of said throttle valve with said predetermined reference pressure value; (4) detecting a value of the opening area of said throttle valve and a value of the opening area of said at least one control valve when the detected value of the pressure of said intake passage downstream of said throttle valve assumes a value indicative of smaller load on said engine with respect to said predetermined reference pressure value; (5) determining a value of a first coefficient on basis of the detected value of the opening area of said throttle valve; (6) determining a value of a second coefficient on the basis of the detected value of the opening area of said at least one control valve; (7) detecting the interval of time between generation of a preceding pulse of said control signal and generation of a present pulse of same; (8) determining a desired amount of fuel to be supplied to said engine on the basis of a sum of the values of said first and second coefficients determined at said steps (5) and (6) and the detected value of the interval of time between generation of the preceding pulse of said control signal and generation of the present pulse of same determined at said step (7); (9) determining a correction value on the basis of a difference between the detected value of the opening area of said throttle valve and an actual value of the opening area thereof and a difference between the detected value of the opening area of said at least one control valve and an actual value of the opening area thereof; (10) correcting the desired amount of fuel determined at said step (8) by said correction value; and (11) supplying said engine with the desired amount of fuel thus corrected.

7. A method as claimed in claim 6, wherein said step (8) comprises determining the desired amount of fuel on the basis of a product value obtained by multiplying a sum of the values of said first and second coefficients by the detected value of the interval of time between generation of the preceding pulse of said control signal and generation of the present pulse of same.

8. A method as claimed in claim 6, wherein said step (9) comprises detecting the rotational speed of said engine, determining a second desired amount of fuel on the basis of the detected value of the rotational speed of said engine and the detected value of the pressure of said intake passage downstream of said throttle valve obtained at said step (1), determining a provisional correction value from the first-mentioned desired amount of fuel obtained at said step (8) and said second desired amount of fuel, in synchronism with generation of pulses of said control signal, determining a mean value of said provisional correction values thus obtained, and employing said mean value as said correction value.

9. A method as claimed in claim 8, wherein the desired amount of fuel determined at said step (8) is corrected by a product value obtained by multiplying said correction value by the detected value of the interval of time between generation of the preceding pulse of said control signal and generation of the present pulse of same, obtained at said step (7).

10. A method as claimed in claim 6, wherein said step (9) comprises determining said correction value on the basis of an output voltage from a variable voltage-creating means which is humanly adjustable.

11. A method as claimed in claim 10, wherein the desired amount of fuel obtained at said step (8) is corrected by a product value obtained by multiplying said correction value by the detected value of the interval of time between generation of the preceding pulse of said control signal and generation of the present pulse of same, obtained at said step (7).

* * * * *